US007643975B2

(12) United States Patent
Vahdati et al.

(10) Patent No.: US 7,643,975 B2
(45) Date of Patent: Jan. 5, 2010

(54) METHOD OF MODELING THE ROTATING STALL OF A GAS TURBINE ENGINE

(75) Inventors: Mehdi Vahdati, London (GB); Naser Savma, Kenley (GB); Mehmet Imregun, London (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 12/076,807

(22) Filed: Mar. 24, 2008

(65) Prior Publication Data

US 2008/0183441 A1 Jul. 31, 2008

Related U.S. Application Data

(63) Continuation of application No. 11/267,172, filed on Nov. 7, 2005, now abandoned.

(30) Foreign Application Priority Data

Dec. 2, 2004 (GB) ..... 0426439.6

(51) Int. Cl.
*G06G 7/48* (2006.01)

(52) U.S. Cl. ..... 703/7

(58) Field of Classification Search ..... 703/7
See application file for complete search history.

(56) References Cited

U.S. PATENT DOCUMENTS 5,437,539 A * 8/1995 Gysling et al. ..... 415/68

OTHER PUBLICATIONS

Gravdahl. 1998, Norwegian Universtiy of Science and Technology., "Modeling and Control of Surge and Rotating Stall in Compress", pp. i-x, 1-141.*

Robert L. Behnken., CDS Technical Memorandum No. CIT-CDS 96-0 14., Sep. 1996 "Nonlinear Control and Modeling of Rotating Stall in an Axial Flow Compressor." p. 1-153.*

Willems, Frank & De Jager, Bram; Modeling and Control of Rotating Stall and Surge: An Overview; Proceedings of the 1998 IEEE International Conference on Control Applications, Trieste, Italy, Sep. 1998.*

Chen et al., "Optimum design of a subsonic axial-flow compressor stage", 2004, www.sciencedirect.com.*

Vahdati et al., "Core-compressor Rotating Stall Simulation With a Multi-Bladerow Model", 2006, www.springerlink.com.*

* cited by examiner

*Primary Examiner*—Paul L Rodriguez
*Assistant Examiner*—Eunhee Kim
(74) *Attorney, Agent, or Firm*—Jeffrey S. Melcher; Manelli Denison Selter PLLC

(57) ABSTRACT

In a method of numerical modelling of the operation of a gas turbine engine, randomly chosen numerical modifications are made to values within the model, to represent a disturbance for triggering rotating stall. This results in a faster onset of rotating stall within the model, reducing the computational effort required to achieve this.

20 Claims, 4 Drawing Sheets

METHOD OF MODELING THE ROTATING STALL OF A GAS TURBINE ENGINE

This is a continuation of U.S. application Ser. No. 11/267,172, filed Nov. 7, 2005, now abandoned.

FIELD OF THE INVENTION

The present invention relates to the fault condition called rotating stall, which can arise in a gas turbine engine.

BACKGROUND OF THE INVENTION

Rotating stall can arise in a gas turbine engine when operating conditions conspire to reduce the flow rate through the engine, until flow through the engine ceases to be even and symmetrical and breaks down in some regions in which flow over the compressor of the gas turbine has become unstable. The unstable regions will typically rotate within the gas turbine. The overall flow rate through the engine reduces, with other significant consequences, such as excessive temperature and vibration and a loss in thrust. Recovery from rotating stall can be difficult to achieve and thus, the recurrence of rotating stall represents a significant operational risk to an engine.

Accordingly, it is desirable to be able to model the onset of rotating stall within a gas turbine engine, but the computational power required to do so can be excessive.

SUMMARY OF THE INVENTION

According to the present invention, there is provided a method of modelling the operation of a gas turbine engine having at least one compressor stage, in which a numerical model is formed, including numerical values calculated for an array of points representing corresponding points within the engine being modelled, and in which modelling of rotating stall within the or each compressor stage is initiated by using numerical values modified to represent a disturbance for triggering rotating stall.

The modification may be at least partly random.

The represented disturbance may include a mistuning of one or more blades of the compressor. The mistuning may represent a variation in one or more of the blade stagger angle, blade lean or blade sweep.

Alternatively, the disturbance may be represented by modified boundary conditions for the model. The boundary conditions which are modified may be those which represent the gas in the region of the compressor inlet. The boundary conditions may represent the gas pressure, temperature or flow angle. The boundary conditions may be modified by modifying values for gas pressure, temperature or flow angle. The boundary conditions may be modified by applying a random modification to each value which is modified. Preferably every boundary condition value represented at the region of the compressor inlet is modified as aforesaid.

The invention also provides a model of the operation of a gas turbine engine, produced in accordance with the method set out above.

In another aspect, the invention provides apparatus for modelling the operation of a gas turbine engine having at least one compressor stage, comprising data processing means operable to execute a numerical model of the engine, which includes values calculated for an array of points which represent corresponding points within the engine, and further comprising stall means operable to initiate modelling of rotating stall within the or each compressor stage by modifying numerical values within the model to represent a disturbance for triggering rotating stall.

The modification may be at least partly random.

The represented disturbance may include a mistuning of one or more blades of the compressor. The mistuning may represent a variation in one or more of the blade stagger angle, blade lean or blade sweep.

Alternatively, the disturbance may be represented by modified boundary conditions for the model. The boundary conditions which are modified may be those which represent the gas in the region of the compressor inlet. The boundary conditions may represent the gas pressure, temperature or flow angle. The boundary conditions may be modified by modifying values for gas pressure, temperature or flow angle. The boundary conditions may be modified by applying a random modification to each value which is modified. Preferably every boundary condition value represented at the region of the compressor inlet is modified as aforesaid.

The invention also provides computer software which, when installed on one or more computer systems, is operable to provide modelling apparatus as defined above.

The invention also provides a carrier medium carrying software as defined in the previous paragraph.

BRIEF DESCRIPTION OF THE INVENTION

Examples of present invention will now be described in more detail, by way of example only, and with reference to the accompanying drawings, in which.

DETAILED DESCRIPTION OF THE INVENTION

Figure 1:
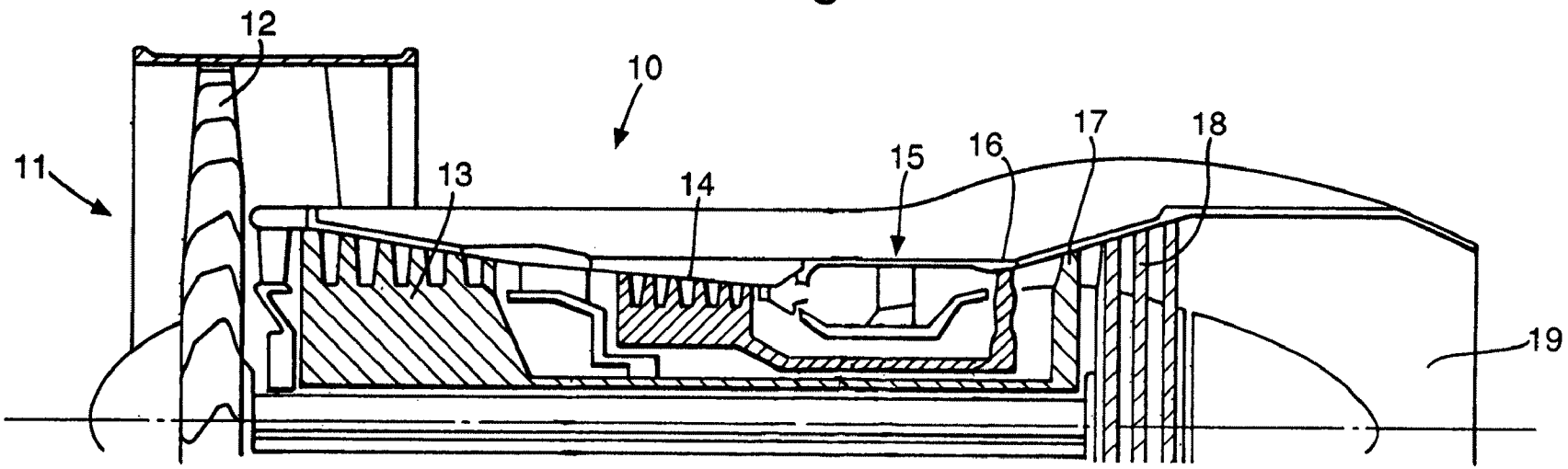
FIG. 1 is a schematic diagram of a gas turbine engine of the type in relation to which the invention may be implemented.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

As has been noted above, rotating stall can occur when the flow rate through the engine is disturbed, either by malfunction or by a change in external conditions. In addition to creating thrust, this flow rate contributes to the cooling of the engine and its various components, so that a rotating stall condition can quickly cause serious or catastrophic damage to components such as turbines, turbine casings etc. Since flow rate is closely linked with engine thrust, thrust is also lost and recovery from the rotating stall condition becomes difficult.

It would be desirable to be able to model the onset and development of rotating stall in a gas turbine engine, for example to assess new designs for their response to the condition. Previous attempts at numerical modelling, using various numerical modelling techniques which are conventional in themselves, have allowed steady state performance of a correctly performing gas turbine engine to be modelled but have not allowed the onset of rotating stall to be modelled successfully, primarily because of the enormous computing power required in order to project models forward sufficiently for rotating stall to have occurred.

The present inventors have realised that in the conventional numerical modelling techniques, the model assumes that the assembly and operation are symmetrical in all respects, so that the only random mechanism within the model is provided by numerical rounding errors etc, i.e. by computational error. These errors will be extremely small in most circumstances, so that the engine may require modelling through many rotations before these effects build sufficiently to give rise to the asymmetry of rotating stall and consequently, the computational effort is very high.

The present inventors propose to superimpose on the numerical model a model of a disturbance which will trigger rotating stall. Two examples of this will now be described.

EXAMPLE 1

Figure 2:
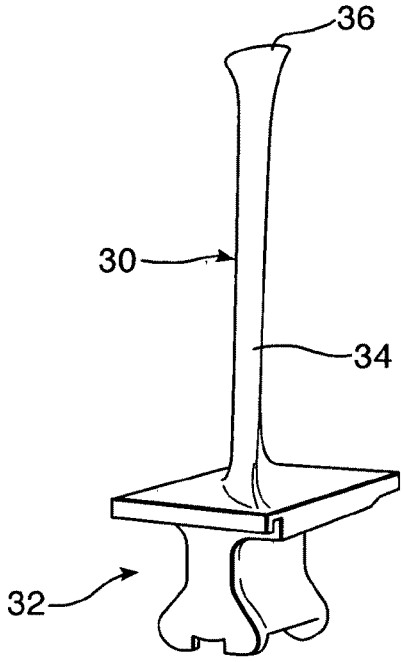
FIG. 2 illustrates a single compressor blade from a compressor of the engine of FIG. 1.
Figure 3:
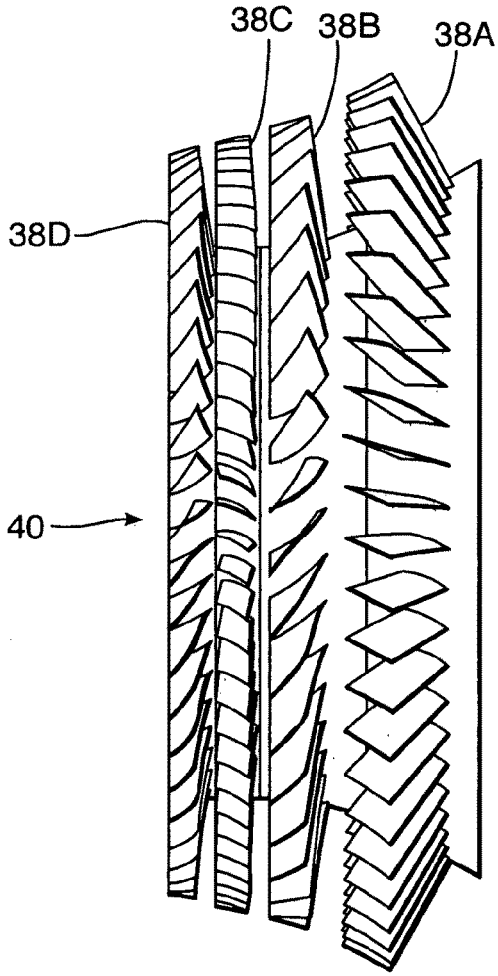
FIG. 3 illustrates a compressor from the engine of FIG. 1, having three rows of compressor blades of the type illustrated in FIG. 2.

In order to explain the first example, it is appropriate to discuss the blade arrangements within a compressor, initially with reference to FIG. 2. FIG. 2 shows a compressor blade 30 which, in use, is mounted by its root 32 to the corresponding shaft (not shown) to be driven by the corresponding turbine. The foil region 34 of the blade 30 extends away from the root 32 to the blade tip 36. The blade 30 will form, in use, one of a ring of blades. A single compressor may be formed of several rings of compressor blades 30. FIG. 3 illustrates, for example, four rings 38A, B, C, D of compressor blades 30, being two rings 38A, 38C of stator blades, and two rings 38B, 38D of rotor blades.

Additionally, guide vanes may be associated with the rings 38, to further enhance the gas flow through the compressor 40.

It can readily be understood that the compressor 40, shown in FIG. 3, is complex. Thus, accurate numerical simulation is difficult, particularly in relation to an asymmetric phenomenon such as rotating stall. The numerical model may require grids containing several tens of millions of points to represent the compressor geometry and consequently, projecting forward the performance of the compressor is highly demanding in terms of computational power.

The situation can be improved, in accordance with the invention, by modifying the numerical values used within the model, to represent a disturbance which will trigger rotating stall. In this example, the disturbance may be one of, or a combination of mistuning effects such as variations from the design values for blade stagger, blade lean or blade sweep.

The concepts of blade stagger, blade lean and blade sweep will be well known to the skilled reader and thus need not be defined further here. In very simple terms, stagger relates to the angle of attack between the blade and the gas stream, lean relates to the blade alignment in a transverse phase, relative to a radial line, and sweep relates to forward tilt, into the incident gas flow. It is appropriate to note that whereas numerical models have hitherto assumed complete symmetry within a gas turbine engine, the position in practice will be different. Manufacturing, assembly and maintenance tolerances will introduce variations from design values for blade stagger, blade lean or blade sweep.

Figure 4:
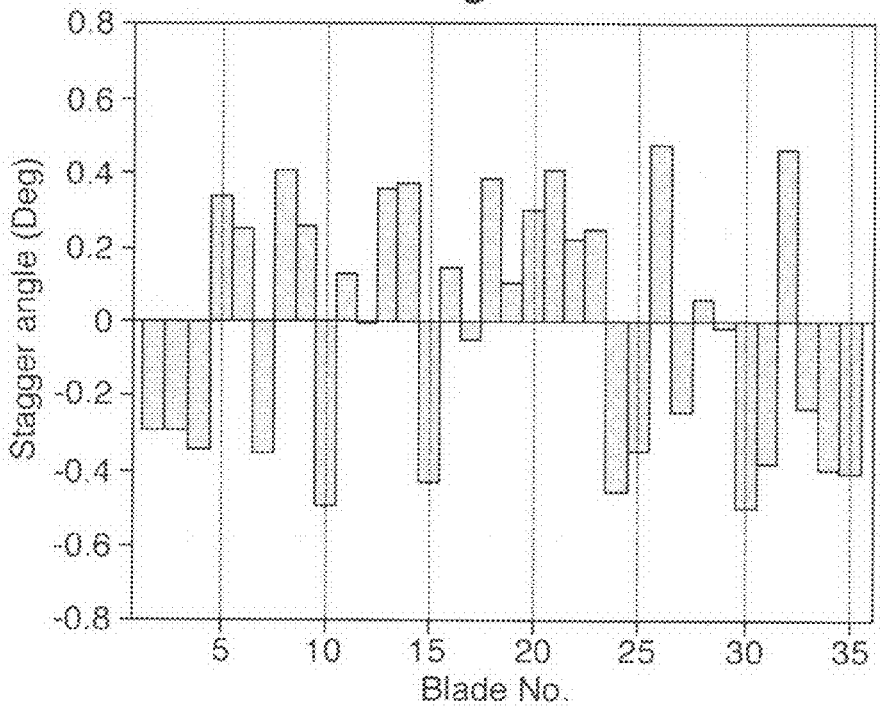
FIG. 4 is a plot of a mistuning pattern applied within a numerical model of the engine of FIG. 1, in accordance with the invention.

In accordance to the present invention, this type of mistuning of the compressor 40 is superimposed on a numerical model by applying a random variation from the nominal value for each blade. Thus, FIG. 4 illustrates values for a small variation in stagger angle, for each of 35 blades in a compressor 40. This number is an example only. It can be seen that the variation from the nominal stagger angle can be either positive or negative and is relatively small (a maximum of about 0.5 degrees). The variation may be due to manufacturing and/or assembly tolerances, for example. It is also apparent from FIG. 4 that the value of stagger angle mistuning applied to each of the 35 blades is a random value within this range.

Thus, the inventors envisage modifying the values within an otherwise conventional numerical model representing the compressor blades 30, by superimposing the variation given by FIG. 4, to result in the model representing a compressor which is mistuned to a degree similar to that which is likely to arise in practice.

Figure 5:
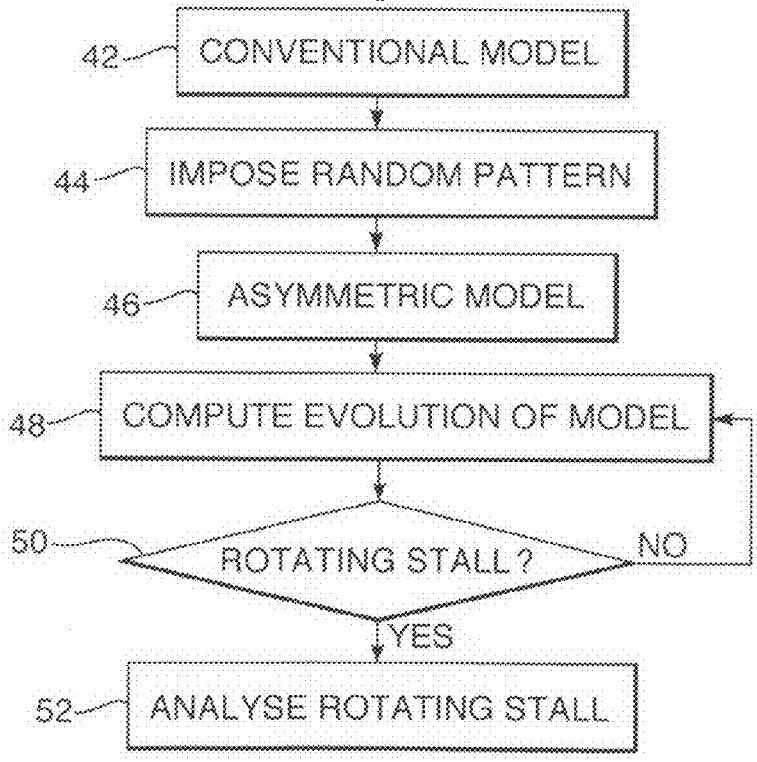
FIG. 5 is a simple flow diagram representing the method of the invention.

Modelling can proceed as indicated in FIG. 5. At 42 a conventional numerical model is created, which may be symmetrical. At step 44, a random modification is imposed on the model, such as described above in relation to FIG. 4. This results at step 46 in an asymmetric model. Step 48 is the computation of the evolution of the asymmetric model, for example through a part or complete rotation. At 50, an assessment can be made as to whether rotating stall has arisen and if not, a further iteration of evolution is executed at 48. When rotating stall is detected at 50, appropriate analysis can be undertaken at 52.

The inventors have realised that by imposing the random modification on the symmetrical model, to create an asymmetric model, and in particular by imposing modifications of a magnitude similar to that likely to be encountered in practice, the resulting asymmetric model is, in effect, modelling the engine with the inclusion of a disturbance of the nature likely to trigger rotating stall. Consequently, the onset of rotating stall will arise much more rapidly as the model evolves. The computational effort required to obtain worthwhile data from the model, in relation to rotating stall, is significantly reduced and becomes feasible with modern processing power.

EXAMPLE 2

Figure 6:
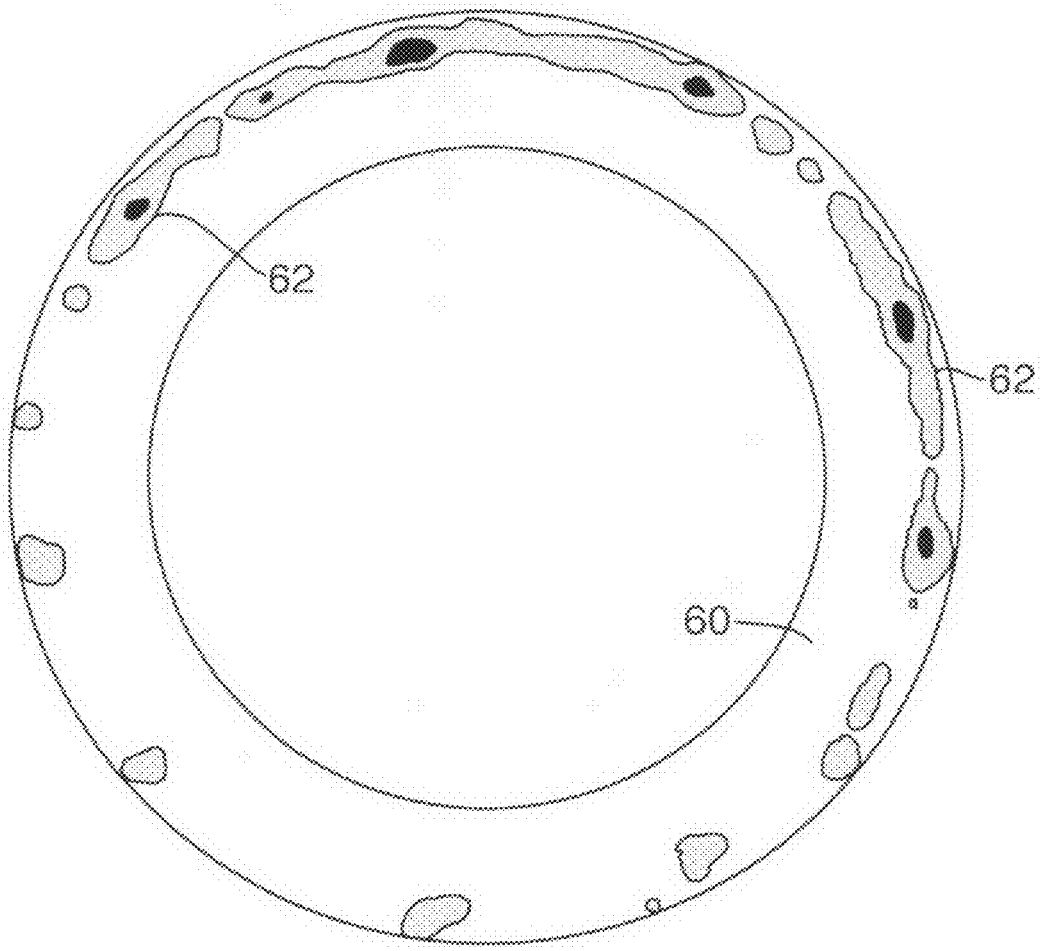
FIG. 6 schematically represents annular flow through a gas turbine engine modelled in accordance with the present invention.

FIG. 6 schematically illustrates the results of an alternative approach, in which numerical values are modified to represent a disturbance within the gas flow, rather than within the structure of the engine.

In a conventional, symmetrical model, gas flow rates and pressures would be assumed to be the same at all points around the annular gas flow path. In this example, this assumption is overturned by superimposing a random variation from the nominal value at each point around the annular path. This equates to the superimposition of white noise.

In a preferred arrangement, boundary conditions of the numerical model are modified by increasing or decreasing the pressure value (or another flow variable) at each point around the annulus by a small amount which is selected at random from a range with a magnitude equivalent to that which would be experienced in practice when the risk of rotating stall exists. This is equivalent to adding white noise to the boundary conditions at the inlet.

Since the direction and magnitude of the modification are chosen at random, the gas flow in the region of the compressor inlet (illustrated in FIG. 6) will remain primarily in the direction of entering the compressor (unshaded area 60 in FIG. 6), but some areas may exist in which negative flow (out from the compressor) exists (shaded areas 62 in FIG. 6). Using this type of modification, the onset of rotating stall can be modelled in the manner illustrated in FIG. 5 and described above, with the modification imposed at step 44 being the change of boundary conditions in the gas flow at the compressor inlet.

Again, it is expected that by imposing this random modification, the computing power required to evolve the numerical model sufficiently to create rotating stall will be significantly reduced and become practical.

It will be understood by the skilled reader that other modification of the numerical values could be introduced, to represent alternative trigger disturbances. However, in each of the examples, the triggering disturbance which is applied is one which emulates physical features likely to arise in practice. Thus, in addition to the technique causing the onset of rotating stall more quickly, the resulting asymmetric model remains realistic.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A method of modeling the operation of a gas turbine engine having at least one compressor stage in which a numerical model is formed, said method comprising the steps of:

generating said numerical model having numerical values that represent the compressor having a symmetrical geometry;

superimposing a variation to said numerical values that represent said compressor with a symmetrical geometry in order to represent a compressor with an asymmetrical geometry such that said numerical values are modified to represent a disturbance for triggering rotating stall;

computing the evolution of the compressor with said asymmetric geometry and determining whether a rotating stall has occurred; and then repeating the above step until a rotating stall occurs; and then analyzing data obtained from the aforementioned steps to determine the cause that triggered said rotating stall.

2. A method according to claim 1, wherein the variation to the numerical values is at least partly random.

3. A method according to claim 1, wherein the disturbance includes a mistuning of one or more blades of the compressor.

4. A method according to claim 3, wherein the mistuning represents a variation in one or more of the blade stagger angle, blade lean or blade sweep.

5. A method according to claim 1, wherein the disturbance is represented by modified boundary conditions for the model.

6. A method according to claim 5, wherein the boundary conditions which are modified are those which represent the gas in the region of the compressor inlet.

7. A method according to claim 5, wherein the boundary conditions represent at least one of gas pressure, temperature and flow angle.

8. A method according to claim 5, wherein the boundary conditions are modified by modifying values for at least one of gas pressure, temperature and flow angle.

9. A method according to claim 8, wherein the boundary conditions are modified by applying a white noise modification to the boundary conditions.

10. A method according to claim 8, wherein every boundary condition value represented at the region of the compressor inlet is modified as aforesaid.

11. Apparatus for modeling the operation of a gas turbine engine having at least one compressor stage, comprising data processing means operable to execute a numerical model of the engine having a compressor with a symmetric geometry, which includes values calculated for an array of points which represent corresponding points within the engine, and further comprising stall means operable to initiate modeling of rotating stall within the at least one compressor stage by modifying numerical values within the model to represent a compressor having an asymmetric geometry which causes a disturbance for triggering rotating stall.

12. Apparatus according to claim 11, wherein the modification is at least partly random.

13. Apparatus according to claim 11, wherein the represented disturbance includes a mistuning of one or more blades of the compressor.

14. Apparatus according to claim 13, wherein the mistuning represents a variation in one or more of the blade stagger angle, blade lean or blade sweep.

15. Apparatus according to claim 11, wherein the disturbance is represented by modified boundary conditions for the model.

16. Apparatus according to claim 15, wherein the boundary conditions which are modified are those which represent the gas in the region of the compressor inlet.

17. Apparatus according to claim 15, wherein the boundary conditions represent at least one of gas pressure, temperature and flow angle.

18. Apparatus according to claim 17, wherein the boundary conditions are modified by modifying values for at least one of the gas pressure, temperature and flow angle.

19. Apparatus according to claim 18, wherein the boundary conditions are modified by applying a white noise modification to the boundary conditions.

20. Apparatus according to claim 18, wherein every boundary condition value represented at the region of the compressor inlet is modified as aforesaid.

* * * * *